US006560848B2

(12) United States Patent
Lee

(10) Patent No.: US 6,560,848 B2
(45) Date of Patent: May 13, 2003

(54) METHOD FOR FORMING MICRO GROOVE ON MOLD USED AT PDP PARTITION MANUFACTURE

(76) Inventor: Eun-Sang Lee, WooSung Apt. #101-906, JamWon-Dong, SeoCho-Ku, Seoul (KR)

( * ) Notice: Subject to any disclaimer, the term of this patent is extended or adjusted under 35 U.S.C. 154(b) by 47 days.

(21) Appl. No.: 09/883,521

(22) Filed: Jun. 18, 2001

(65) Prior Publication Data

US 2002/0044845 A1 Apr. 18, 2002

(30) Foreign Application Priority Data

Jul. 11, 2000 (KR) ..... 39540

(51) Int. Cl.[7] ..... B23P 13/04; B25D 3/06
(52) U.S. Cl. ..... 29/558; 83/877; 83/49
(58) Field of Search ..... 29/557, 558; 164/6; 83/864, 877, 49, 52

(56) References Cited

U.S. PATENT DOCUMENTS 3,525,145 A * 8/1970 Bonnefoy et al. ..... 29/558
3,528,665 A * 9/1970 Redlich ..... 29/558
4,685,193 A * 8/1987 Faria et al. ..... 29/428
4,760,635 A * 8/1988 Miller ..... 29/558
4,884,331 A * 12/1989 Hinshaw ..... 165/185
5,185,917 A * 2/1993 Kremen ..... 29/558
5,266,528 A * 11/1993 Yamada ..... 148/DIG. 28
5,853,446 A * 12/1998 Carre et al. ..... 427/383.5
6,072,566 A * 6/2000 Fujii et al. ..... 356/15
6,106,252 A * 8/2000 Yamanaka et al. ..... 29/557
6,251,208 B1 * 6/2001 Serizawa et al. ..... 156/232
6,321,571 B1 * 11/2001 Themont et al. ..... 156/230
6,333,142 B1 * 12/2001 Toyoda et al. ..... 430/320
6,394,163 B1 * 5/2002 Shirakawa ..... 156/433
6,450,850 B1 * 9/2002 Nunomura ..... 445/24

* cited by examiner

*Primary Examiner*—David P. Bryant
(74) *Attorney, Agent, or Firm*—Notaro & Michalos P.C.

(57) ABSTRACT

Disclosed is a method for forming a micro groove on a PDP mold by preparing the PDP mold using a steel-based mold and rotating a CBN metal bond blade at a high speed to form the micro groove on a surface of the PDP mold at multiple steps, thereby increasing a precision thereof and reducing a manufacturing cost.

8 Claims, 4 Drawing Sheets

METHOD FOR FORMING MICRO GROOVE ON MOLD USED AT PDP PARTITION MANUFACTURE

BACKGROUND OF THE INVENTION

1. Field of the Invention

The present invention relates to a method for forming a micro groove on a mold used at a PDP partition manufacture, and more particularly to a method for forming a micro groove on a PDP mold by preparing the PDP mold using a steel-based mold and rotating a CBN metal bond blade at a high speed to form the micro groove on a surface of the PDP mold at multiple steps, thereby increasing a precision thereof and reducing a manufacturing cost.

2. Description of the Related Art

Generally, copper or brass is used to make a mold for forming a partition of a plasma display panel (PDP), and the mold made of copper or brass is formed with a groove having a shape opposite to that of the partition of the PDP by a shaping process.

Since the lifetime of the mold made of copper or brass is relatively short, however, the manufacturing cost increases. Therefore, it is improper to employ such a mold to form the partition, in view of a general tendency of a large-sized screen of the PDP.

SUMMARY OF THE INVENTION

Therefore, in order to solve the problem involved in the prior art, it is an object of the present invention to provide a method for forming a micro groove on a PDP mold by preparing the PDP mold using a steel-based mold, wherein the method is applied to the mold for manufacturing a PDP partition according to a tendency of a large-sized screen of the PDP, thereby increasing a precision thereof and reducing a manufacturing cost.

In order to achieve the above object, according to one aspect of the present invention, there is provided a method for forming a micro groove on a PDP mold by preparing the PDP mold using a steel-based mold and rotating a cubic boron nitride (CBN) blade at a high speed above 30,000 rpm to form the micro groove on a surface of the PDP mold.

The method for forming a micro groove on the PDP mold comprises the steps of: primarily cutting a rectangular micro groove on the mold using a super precise CBN blade for manufacturing the PDP partition made of steel; and secondarily cutting the micro groove formed at the primary step using other blade to have a trapezoid shape or a deep rectangular shape, or removing a V-shaped burr.

BRIEF DESCRIPTION OF THE DRAWINGS

The above objects, other features and advantages of the present invention will become more apparent by the preferred embodiments described with reference to the accompanying drawings, in which.

DETAILED DESCRIPTION OF THE PREFERRED EMBODIMENT

Now, a method for forming a micro groove on a mold used at a PDP partition manufacture according to a preferred embodiment of the present invention will be described in detail with reference to the accompanying drawings.

As a solution to cope with a tendency of a large-sized screen of the PDP mold, as well as replacing copper or brass, which is expensive and the lifetime is short, with steel, according to the preferred embodiment of the present invention, there is provided a method for forming a micro groove on the PDP mold by preparing the PDP mold using a steel-based mold and cutting the micro groove using a dicing machine with a pneumatic spindle, a blade being mounted onto the pneumatic spindle.

The cutting of the micro groove is performed by a same principle as that of a typical grinding. Since a thickness of the blade is very thin in order of 30 to 150 $\mu$m, there is no problem that the micro groove is cut by a depth of 300 $\mu$m. Preferably, the blade used at the micro groove cutting is a CBN metal bond blade having a different structure as an electrolyzation deposited diamond blade.

Figure 1A:
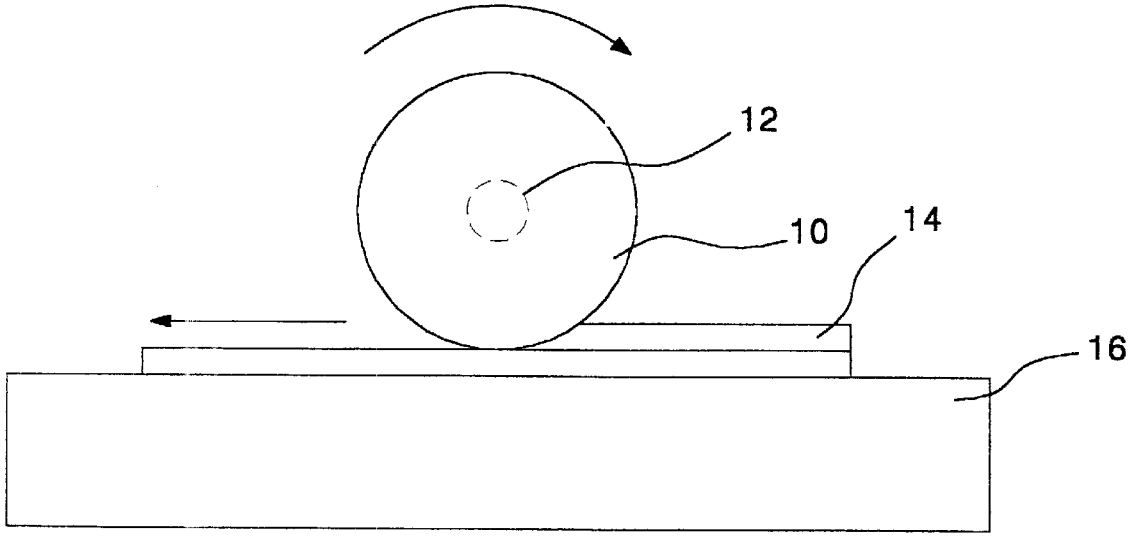
FIGS. 1*a* and 1*b* are views illustrating a process of cutting a micro groove on a surface of a PDP mold according to the present invention.
Figure 1B:
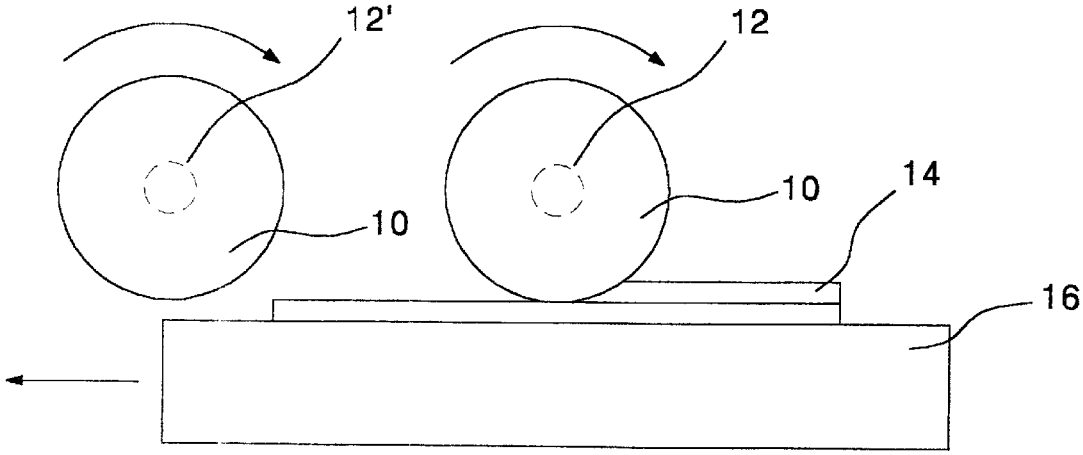

FIGS. 1*a* and 1*b* are views illustrating a process of cutting a micro groove on a surface of a PDP mold according to the present invention. As shown in FIGS. 1*a* and 1*b*, after the CBN blade 10 for cutting a micro groove is mounted onto a pneumatic spindle 12, the PDP mold 14 is moved to be formed with the micro groove, with the pneumatic spindle 12 being rotated at a rotating speed of above about 30,000 rpm.

At that time, preferably, a chuck 16 for mounting the PDP mold 14 is rotated at a very low rotating speed, for example 1 to 2 mm/s, to reduce a cutting resistance. Each of the CBN blades 10 and 10' is mounted onto the pneumatic spindles 12 and 12' connected in series to each other, such that the micro groove may be cut at two steps. The two-steps cutting will now be described with reference to FIG. 3.

Figure 2:
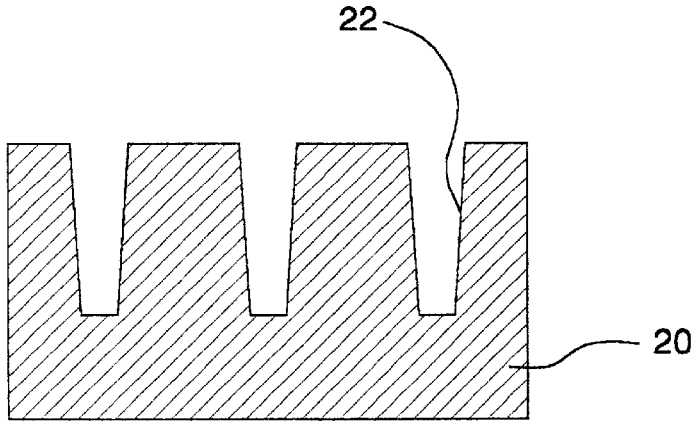
FIG. 2 is a sectional view illustrating a shape of a micro groove formed on a surface of a PDP mold.

FIG. 2 is a sectional view illustrating a shape of a micro groove 22 formed on a surface of a PDP mold 20 according to the process described above. As shown in FIG. 2, it is very difficult to maintain the micro groove in a proper shape because of the cutting resistance. In order to solve the above problem, according to the preferred embodiment of the present invention, there is provided a method for forming a micro groove on a metal mold for the PDP partition manufacture by two steps to improve a shape precision.

Figure 3:
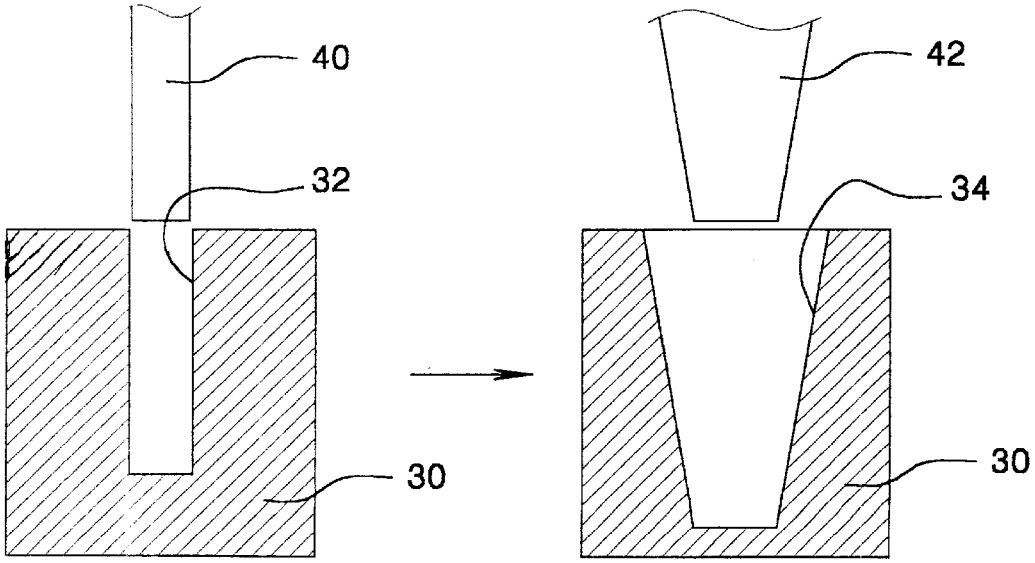
FIG. 3 is a sectional view illustrating two-steps process of a cutting to improve a cutting precision at machining a micro groove on a surface of a PDP mold.

As shown in FIG. 3, after a groove 32 having a rectangular cross section is primarily machined on a PDP molding 30 using a blade 40 having a rectangular cross section, the groove is secondarily machined using a blade 42 having a trapezoid cross section. At the primary step the groove is roughed by the blade 40 having a rectangular cross section, and at the secondary step the groove is finished by the blade 42 having a trapezoid cross section. Since a shape of the groove is substantially formed at the primary step, the cutting resistance is significantly reduced at the secondary step, thereby allowing the groove to have a desired shape.

At that time, two blades are necessary to the two step processes. To this end, after two pneumatic spindles 12 and 12' are mounted in series as shown in FIG. 1B, the blade 40 having a rectangular cross section is mounted onto the front spindle 12 for the primary cutting, while the blade 42 having a trapezoid cross section is mounted onto the rear spindle 12' for the secondary cutting.

In order to improve a surface roughness and to prevent a shape of the groove from being changed due to the abrasion of the blade, it is possible to provide a number of pneumatic spindles in series so as to cut the groove by dividing the machining step into at least three steps.

Figure 4:
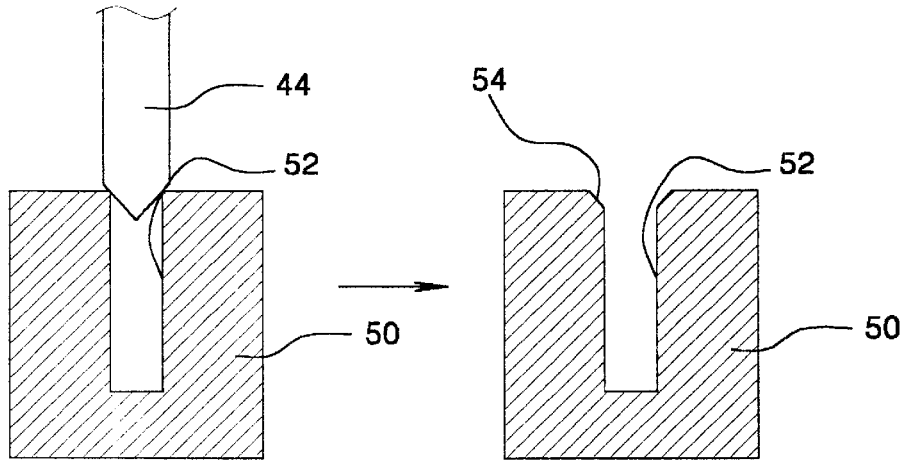
FIG. 4 is a sectional view illustrating a process of removing a corner burr after a primary step of a vertical cutting.

Also, as shown in FIG. 4, after a groove 52 having a rectangular cross section may be primarily a PDP mold 50 using a rectangular blade (designated by reference numeral 44 in FIG. 4), and then only corner burr may be secondarily removed using a blade 44 having a V-shaped end surface. Reference numeral 54 in FIG. 4 indicates a shape of the groove with the burr removed.

When a rectangular groove is cut with the feature of the present invention, the groove having a deep depth may be cut at multiple steps.

By way of example of such a machining;

(1) As shown in FIG. 3, after the PDP mold 30 is primarily cut to form the rectangular groove 32, the groove 32 may be cut so as to be changed into the groove 34 having the trapezoid cross section.

(2) After the PDP mold is primarily cut to form the rectangular groove 32 as shown in FIG. 3, the groove 32 may be secondarily finished using the blade 40 having a same rectangular cross section as that of the groove.

(3) In case of cutting a groove having a depth of 400 $\mu$m, the groove may be gradually cut in several steps using single blade, for example in order of depth of 100 $\mu$m by once.

(4) As shown in FIG. 4, after the PDP mold 50 is primarily cut using the blade 40 having a rectangular cross section to form the rectangular groove 52, the burr of the corner portion may be secondarily removed using the blade 44.

Figure 6:
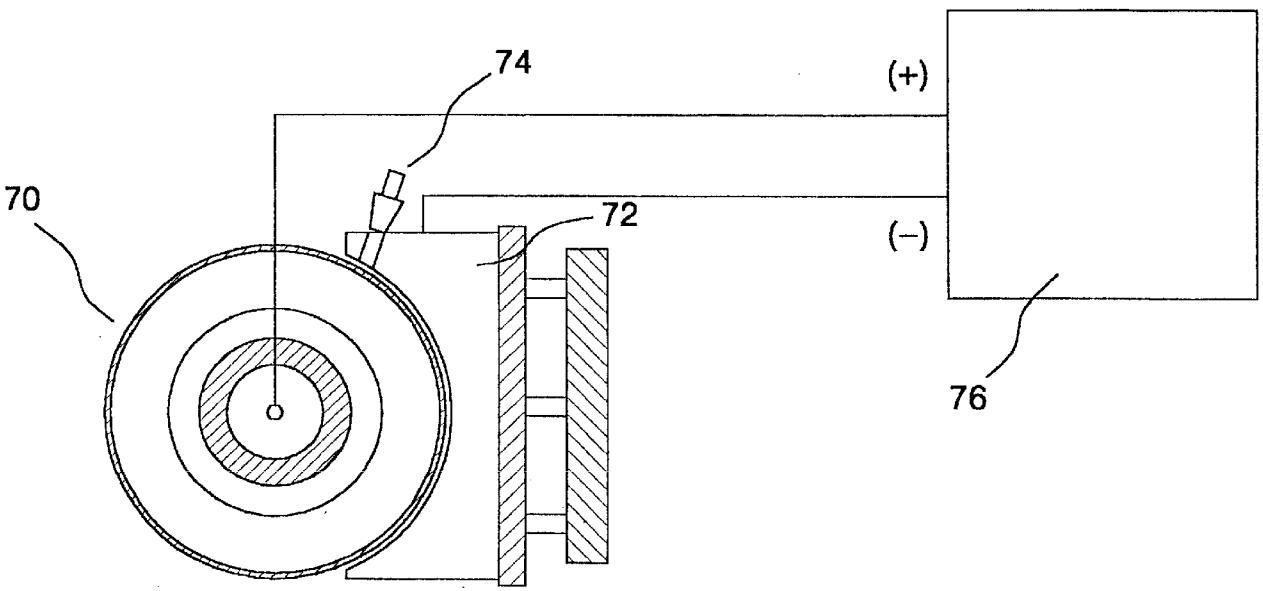
FIG. 6 is a view illustrating a metal bond blade for a finishing, the blade applied with an electrolyzation dressing.

(5) As shown in FIG. 3, after the mold is primarily cut to form the rectangular groove 32, the groove 32 may be secondarily cut so as to be changed into the trapezoid groove 34, and then the surface of the groove may be finally finished using an electrode dressing machining as shown in FIG. 6.

Figure 5:
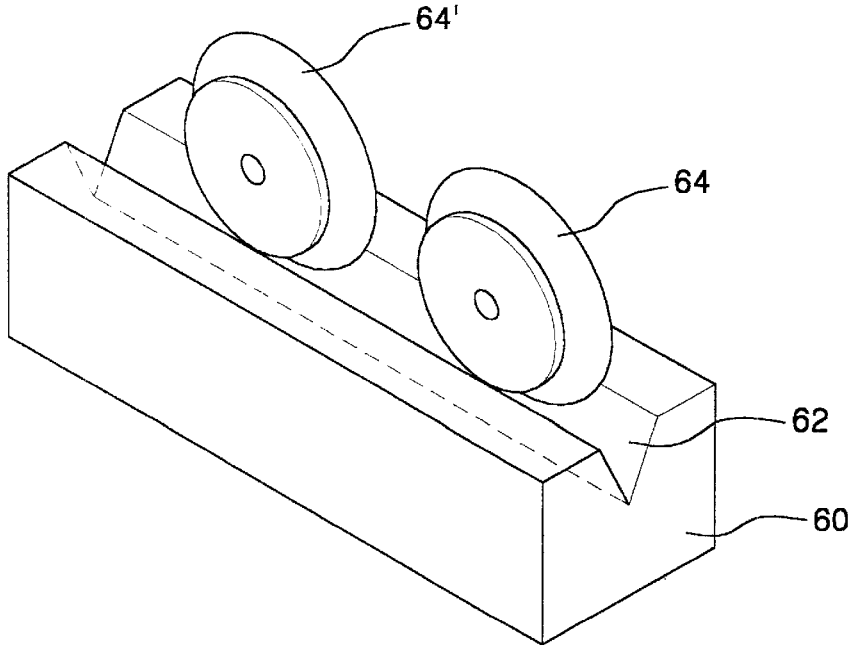
FIG. 5 is a perspective view illustrating a construction of a jig having a V-shaped groove for setting, dressing and throwing multi-stage in-series blade.

FIG. 5 is a perspective view illustrating a construction of a jig having a V-shaped groove for setting, dressing and throwing multi-stage in-series blades, in which two blades must be precisely arranged in line in order to mount and arranged two blades. To this end, according to the preferred embodiment of the present invention two or more CBM blades 64 and 64' using a jig 60 having a V-shaped groove 62.

In addition, FIG. 6 is a view illustrating a metal bond blade for a finishing, the blade applied with an electrolyzation dressing. In order to provide the cut surface of the groove with a mirror surface, there is provided a method for improving a machining quality by employing an electrolyzation continuous dressing apparatus. This method is similar to an electrolyzation continuous dressing method in a typical grinding work. After an electrode 72 is provided on a metal bond blade 70 for a finishing, the micro groove is electrode-dressed by injecting an electrolyte through a nozzle 74, thereby carrying out a mirror surface grinding.

With the construction of the present invention, metallic material such as STD-11 may be used as a material of the mold for PDP mold, so that the lifetime of the mold can be extended, and the manufacturing cost can be significantly reduced.

In addition, the present invention machines the micro groove on the surface of the PDP mold at multiple steps, thereby maintaining the shape precision of the micro groove in a high level.

Although some preferred embodiments have been described, many modifications and variations may be made thereto in the light of the above teachings. It is therefore may be practiced otherwise than as specifically described.

What is claimed is:

1. A method for forming a micro groove on a PDP mold comprising the steps of:

forming the PDP mold of a steel-based material;

rotating at least two cubic boron nitride blades at high speed; and moving the blades into contact with a surface of the PDP mold for cutting a micro groove in the PDP mold; wherein the blades are mounted on at least two pneumatic spindles in series so that the micro groove is formed in two steps in a continuous process by the two respective blades.

2. The method of claim 1, including providing a jig with a V-shaped groove for aligning the blades mounted on the spindles in series.

3. The method of claim 1, including rotating the blades at a speed of about 30,000 rpm.

4. A method for forming a micro groove on a PDP mold, the method comprising the steps of:

initially cuffing a rectangular micro-groove on a surface of the mold, the mold being made of metallic material and the cutting taking place using a CBN blade; and subsequently cutting the micro groove further using an additional blade to change the shape of the micro groove.

5. The method of claim 4, further comprising electrolytically dressing the blades to provide the blades with a smooth surface so that the micro groove is formed to have a mirror surface.

6. The method of claim 4, wherein the second cutting step forms the micro groove to have a trapezoidal shape.

7. The method of claim 4, wherein the second cutting step forms the groove to have a deeper rectangular shape.

8. The method of claim 4, wherein the second cutting step forms a V-shaped opening at the top of the micro groove.

* * * * *